US006986408B2

(12) United States Patent
Takeuchi

(10) Patent No.: US 6,986,408 B2
(45) Date of Patent: Jan. 17, 2006

(54) REMOTELY CONTROLLED ELEVATOR OPERATING APPARATUS

(75) Inventor: Nobukazu Takeuchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 166 days.

(21) Appl. No.: 10/466,903

(22) PCT Filed: Dec. 20, 2001

(86) PCT No.: PCT/JP01/11193

§ 371 (c)(1),
(2), (4) Date: Jul. 23, 2003

(87) PCT Pub. No.: WO03/053835

PCT Pub. Date: Jul. 3, 2003

(65) Prior Publication Data

US 2004/0060777 A1 Apr. 1, 2004

(51) Int. Cl.
*B66B 1/16* (2006.01)

(52) U.S. Cl. ..... 187/380; 187/247; 187/391

(58) Field of Classification Search ..... 187/247, 187/248, 380, 382, 391–398, 384, 389; 704/275, 704/270

See application file for complete search history.

(56) References Cited

U.S. PATENT DOCUMENTS

| | | | | |
|---|---|---|---|---|
| 5,541,585 | A * | 7/1996 | Duhame et al. | 340/5.62 |
| 5,554,832 | A * | 9/1996 | Lumme et al. | 187/380 |
| 5,749,443 | A * | 5/1998 | Romao | 187/384 |
| 5,806,017 | A * | 9/1998 | Hancock | 701/209 |
| 5,952,626 | A | 9/1999 | Zaharia | |
| 6,223,160 | B1 | 4/2001 | Kostka et al. | |
| 6,233,160 | B1 * | 5/2001 | Shockley | 361/833 |
| 6,615,175 | B1 * | 9/2003 | Gazdzinski | 704/275 |
| 6,828,918 | B2 * | 12/2004 | Bowman et al. | 340/825.19 |
| 6,868,945 | B2 * | 3/2005 | Schuster et al. | 187/380 |
| 2003/0159890 | A1 * | 8/2003 | Schuster et al. | 187/247 |
| 2004/0095237 | A1 * | 5/2004 | Chen et al. | 340/506 |

FOREIGN PATENT DOCUMENTS

| | | | |
|---|---|---|---|
| JP | 01242374 | A * | 9/1989 |
| JP | 1-292555 | | 11/1989 |
| JP | 4-121370 | | 4/1992 |
| JP | 05000775 | A * | 1/1993 |
| JP | 5-278962 | | 10/1993 |
| JP | 7-240974 | | 9/1995 |
| JP | 9-77400 | | 3/1997 |
| JP | 9-331579 | | 12/1997 |
| JP | 10-187456 | | 7/1998 |
| JP | 2001-2333 | | 1/2001 |
| JP | 10-316318 | | 4/2001 |
| JP | 2001-092671 | | 4/2001 |
| JP | 2001-337832 | | 12/2001 |

* cited by examiner

*Primary Examiner*—Jonathan Salata
(74) *Attorney, Agent, or Firm*—Leydig, Voit & Mayer, Ltd.

(57) ABSTRACT

A controller for a car/hall apparatus transfers an elevator operating program stored in a memory to an operating terminal through operating terminal communication unit and an operating terminal communication path, when necessary. The operating terminal which has received the elevator operating program executes this program to control an elevator car and a hoisting machine through the operating terminal communication path, the car/hall apparatus, a car/hall communication path, and a controlling apparatus.

19 Claims, 11 Drawing Sheets

FIG. 11

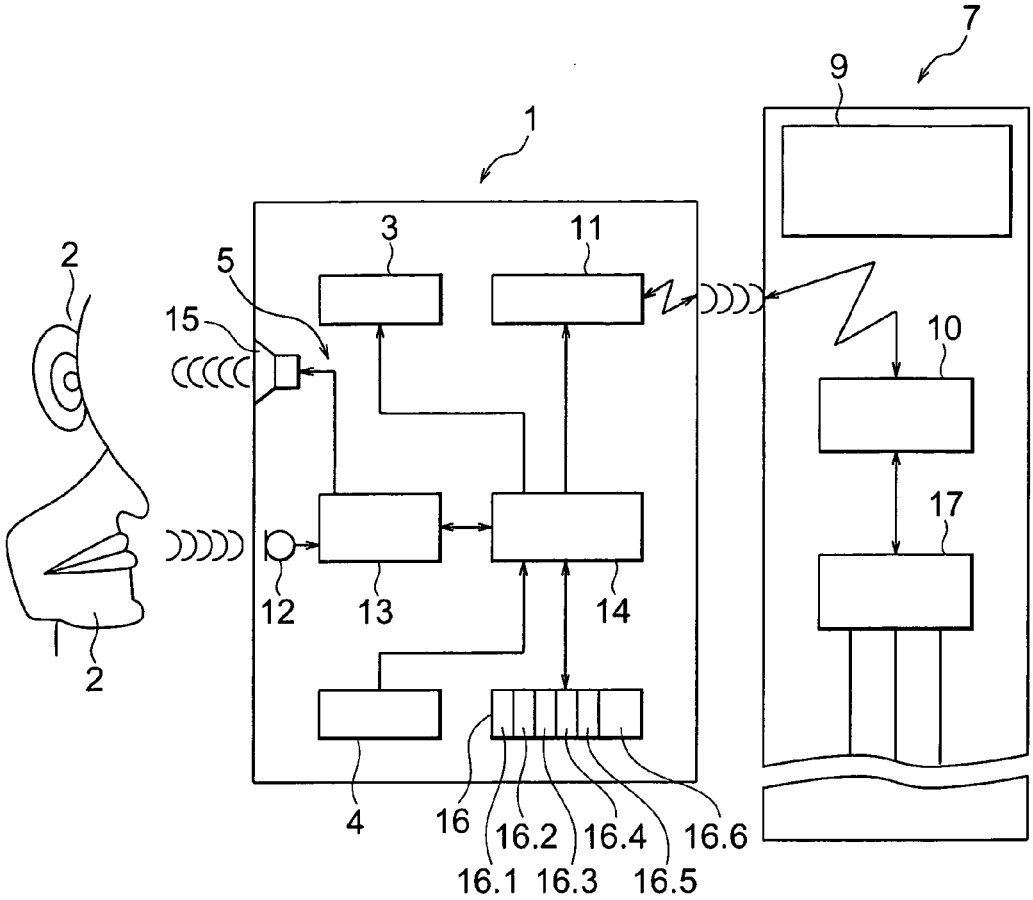

1 : PORTABLE INPUT APPARATUS
2 : USER
3 : FIRST DISPLAY
4 : FIRST KEYBOARD
5 : AUDIO UNIT FIRST KEYBOARD
6 : AUDIO UNIT
7 : DESTINATION FLOOR CALL TERMINAL
9 : SECOND DISPLAY
10 : SECOND TRANSMITTING/RECEIVING APPARATUS
11 : FIRST TRANSMITTING/RECEIVING APPARATUS
12 : MICROPHONE
13 : VOICE CONVERTING APPARATUS
14 : FIRST CONTROLLING APPARATUS
15 : SPEAKER
16 : MEMORY DEVICE
17 : SECOND CONTROLLING APPARATUS

REMOTELY CONTROLLED ELEVATOR OPERATING APPARATUS

TECHNICAL FIELD

The present invention relates to an elevator operating apparatus for operating an elevator, and especially to an operating apparatus eliminating installation of a program at an operating terminal.

BACKGROUND ART

For example, in prior art disclosed in JP 09-077400 A and JP 10-316318 A, as shown in FIG. 10 and FIG. 11, terminals (a call registration operating apparatus and an input apparatus, respectively) are provided with input means (such as a keyboard and a voice command input apparatus) for inputting operation data such as call registration, communication means (a data transmitting/receiving unit and a transmitting/receiving apparatus) with an elevator system, and display means (such as a destination floor arrival confirmation signal outputting unit, an audio unit, and a speaker) for outputting display data such as arrival and an assigned car number.

JP 09-077400A is devised to solve such a problem that a visually handicapped person cannot see a destination floor shown on a call registration button provided on a car operating panel of an elevator, and has difficulty in the operation. A method using voice recognition and a method using Braille are disclosed as prior art for solving this problem in this invention. However, it is anticipated that the first method (voice recognition) has such problems that the cost increases and the registration is hardly conducted if the ambient noise level is high, and the second method (Braille) has such a problem that an arrival at a destination floor cannot be recognized correctly. These problems are solved by preparing a portable call registration apparatus which allows use of a radio signal for registering a call, and registration confirmation by sound or vibration.

Also, in JP 10-316318 A, an operating terminal which can separate time and place from an elevator system for a call input is provided to solve the aforementioned problem relating to the ambient noise when the voice recognition is used. Consequently, it is expected that a noise in a crowded elevator hall and a waiting time for input no longer matter. Also, with this invention, since individual user owns the operating terminal, it is possible to make personal authentication, to show an assigned elevator or escalator to ride on, to input a destination floor using a synonymous concept other than a floor number, to add other functions such as a phone, a beeper, and a vending machine, and to permit/restrict car delivery to a specific floor based on personal authentication.

In the prior art described above, a method is contemplated, in which a dedicated operating terminal is prepared for an elevator, or a dedicated program for an elevator is installed on an operating terminal in advance. However, an elevator is highly public, and it is not practical to prepare an operating terminal dedicated to an elevator for an arbitrary individual user, or to install a program for an elevator on an operating terminal for all users in advance in terms of cost as well.

It is also necessary to adapt an operating terminal to all differences in functions and specifications of individual elevator systems (how to register a landing call, and how to guide, e.g., how to register a destination floor), and it is very difficult to change an operating terminal (or a program in it) every time a new function or a new model is added since the extent of the program and labor of the renewal increase.

An object of the present invention is to realize an elevator operating apparatus which solves these problems, and is provided with an operating terminal which is not dedicated to an elevator, does not require (statically) installing a program dedicated to an elevator, and adapted to all the elevator systems, on an operating terminal of a user in advance, and does not require the user to renew (update) a program.

DISCLOSURE OF INVENTION

An elevator operating apparatus according to the present invention is characterized by including:

an elevator system for storing a program;

an operating terminal connected with the elevator system through a wireless or wired network for executing the program under a virtual execution environment; and communication means for transferring the program from the elevator system to the operating terminal.

Also, the elevator operating apparatus according to the present invention is characterized in that the operating terminal includes request detecting means for detecting a request input from the outside or a state where a request can be estimated, thereby the communicable elevator system is detected through scanning based on a detection result from the request detecting means so that the system is selected.

Further, the elevator operating apparatus according to the present invention is characterized in that the elevator system selected by the operating terminal selects a program to be transferred to the operating terminal based on operating terminal information obtained from the operating terminal.

Further, the elevator operating apparatus according to the present invention is characterized in that:

the elevator system includes at least one car/hall apparatus, that store the program and a controlling apparatus for controlling the car/hall apparatus; and the program is transferred from the car/hall apparatus to the operating terminal.

Further, the elevator operating apparatus according to the present invention is characterized in that:

the elevator system includes at least one car/hall apparatus, and a controlling apparatus for controlling the car/hall apparatus and storing the program; and the program is transferred from the storage apparatus to the operating terminal.

Further, the elevator operating apparatus according to the present invention is characterized in that:

the elevator system includes at least one car/hall apparatus, a storage apparatus connected with the car/hall apparatus for storing the program, and a controlling apparatus for controlling the car/hall apparatus; and the program is transferred from the storage apparatus to the operating terminal.

Further, the elevator operating apparatus according to the present invention is characterized in that the elevator system is provided with an updating apparatus for updating the program.

BRIEF DESCRIPTION OF THE DRAWINGS

FIG. 11 is a block diagram showing another conventional elevator system.

BEST MODE FOR CARRYING OUT THE INVENTION

Hereinafter, a description will be given of embodiments of the present invention while referring to accompanying drawings.

First Embodiment

Figure 1:
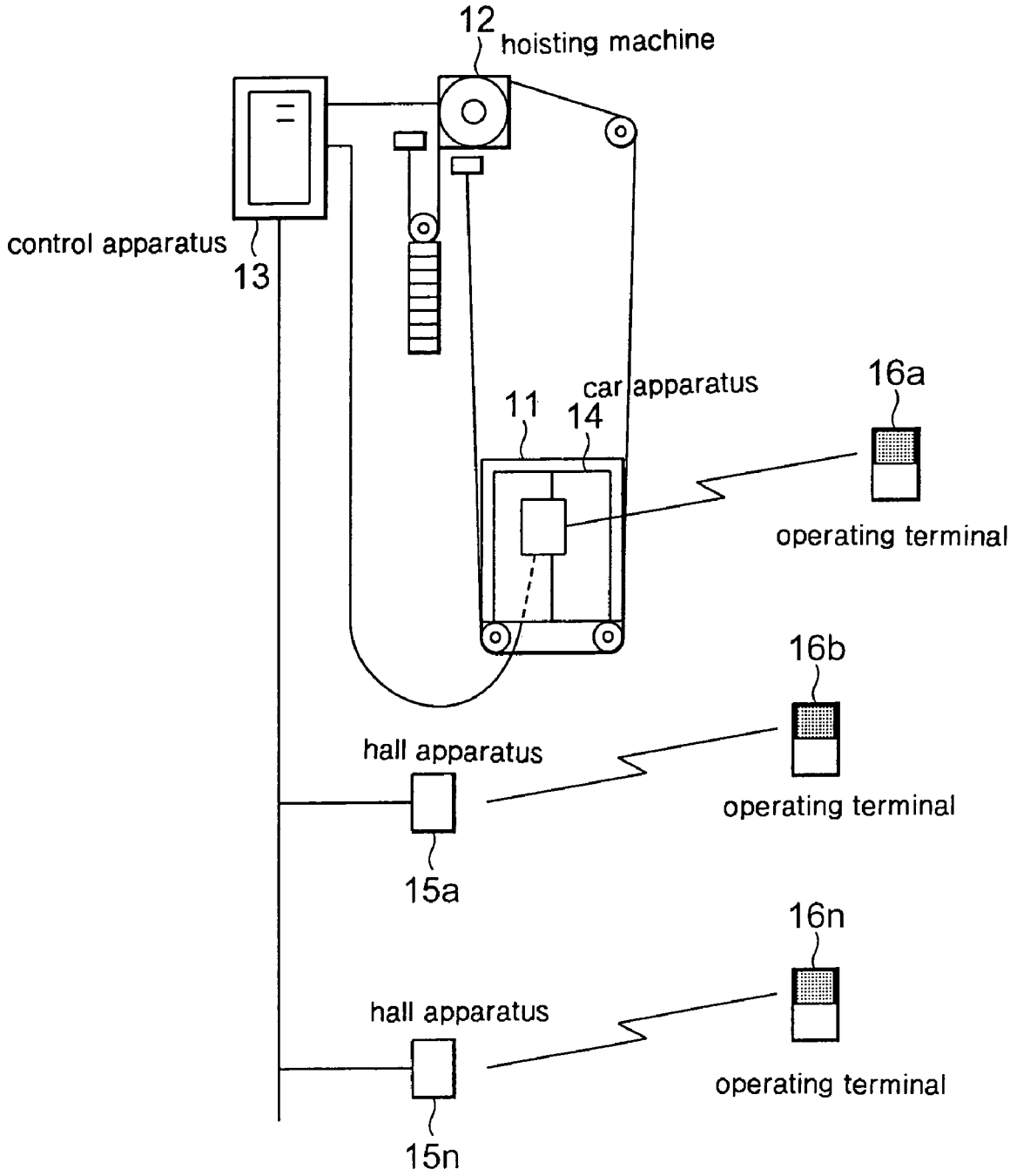
FIG. 1 is a block diagram showing an operating apparatus for an elevator according to a first embodiment.

FIG. 1 is a block diagram showing an operating apparatus for an elevator according to a first embodiment. As shown in FIG. 1, the elevator operating apparatus of the present invention includes an elevator system constituted by at least one car 11, a hoisting machine 12, and a controlling apparatus 13 for controlling them, either one of or both of at least one car apparatus 14 and hall apparatus 15, and operating terminals 16.

Note that a general-purpose operating terminal is used as the operating terminal.

The car apparatus 14 is installed in the car 11, and the hall apparatus 15 is installed in the hall. If the elevator system has multiple cars 11 (multiple elevators), the numbers of car apparatuses 14 and hall apparatuses 15 can be increased or decreased accordingly. The car apparatus 14 and the hall apparatus 15 may additionally include operating means such as a button and a touch panel operated by a user, and display means such as an LED, a lamp, and an LCD showing an operation state of the operating means (such as a destination registration state, and a call state) and an elevator state (such as going up/down, and a current floor) as a conventional operating apparatus. The car apparatus 14 and the hall apparatus 15 have communication means for communicating with the operating terminal 16 and the controlling apparatus 13. The communication means may be realized by either wired communication such as UART, USB, IEEE 1394, and Ethernet, or wireless communication such as IEEE 803.11, and BlueTooth. When a user carrying the operating terminal 16 makes connection with the wired communication, or moves into a communication range of the wireless communication in the hall or car 11, the operating terminal 16 is brought into a communicable state with the car apparatus 14 and the hall apparatus 15.

Figure 2:
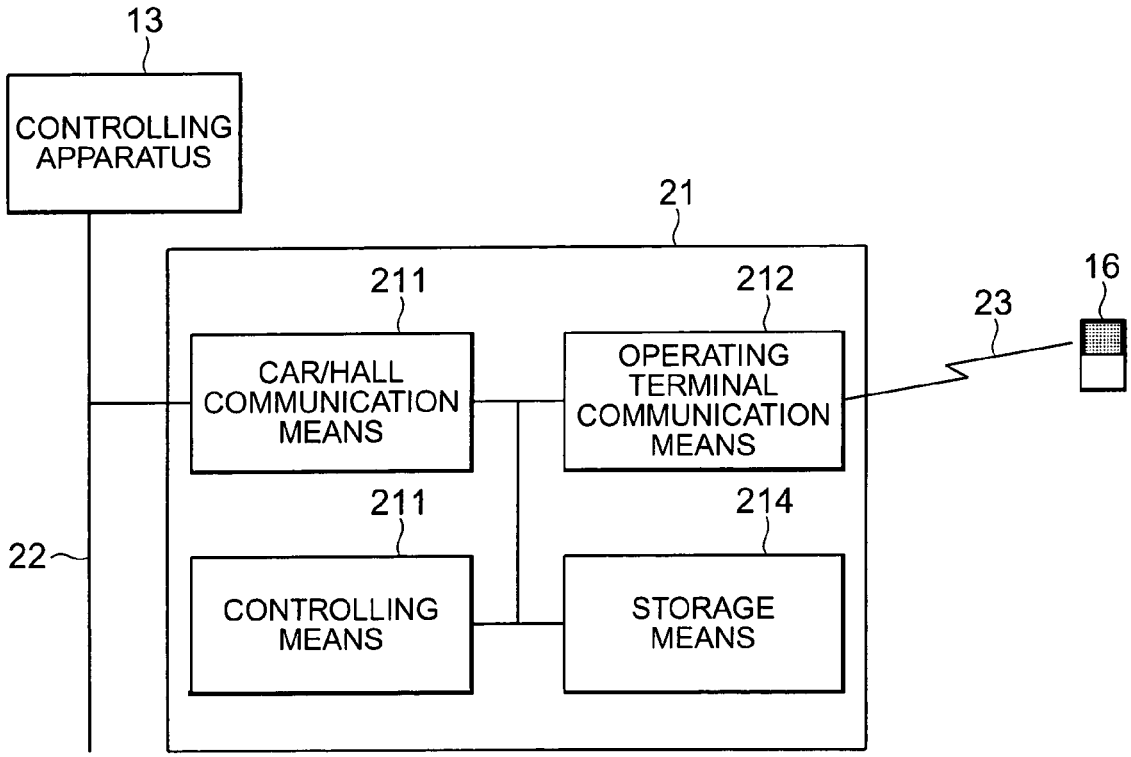
FIG. 2 is a drawing showing an example of a car/hall apparatus.

The car apparatus 14 and the hall apparatus 15 will be collectively referred to as a car/hall apparatus, and the construction of the car/hall apparatus along with the operating terminal and the controlling apparatus are shown in FIG. 2. As shown in FIG. 2, reference numeral 21 indicates the car/hall apparatus. The car/hall apparatus 21 includes car/hall communication means 211 for communicating with the controlling apparatus 13 through a car/hall communication path 22, operating terminal communication means 212 for communicating with the operating terminal 16 through an operating terminal communication path 23, controlling means 213 for controlling them, and storage means 214 for storing an operating terminal program executed under a virtual execution environment. The controlling means 213 includes a microcomputer (hereinafter, referred to as microcomputer) which is not shown and conducts control, a memory for storing a program executed by the microcomputer, a memory used when the program is executed, and the like. The individual operating terminal communication means 212 includes a communication microcomputer, and either both of a memory and a communication interface device or only the communication interface device used by the communication microcomputer. The storage means 214 includes a memory, especially a nonvolatile flash memory or the like.

Next, the operation will be described. The controlling means 213 of the car/hall apparatus 21 controls the operating terminal communication means 212 to communicate with the operating terminal 16, and controls the car/hall communication means 211 to communicate with the controlling apparatus 13. A program stored in the storage means 214 of the car/hall apparatus 21 is transferred to the operating terminal 16 through the operating terminal communication means 212 and the operating terminal communication path 23 under the control of the controlling means 213. The operating terminal 16 executes the transferred program under a virtual execution environment. Consequently, an execution result (information on the operation by a user) is transmitted from the operating terminal 16 to the car/hall apparatus 21 through the operating terminal communication path 23, and is transmitted to the controlling means 213 through the operating terminal communication means 212 in the car/hall apparatus 21. The controlling means 213 communicates with the controlling apparatus 13 through the car/hall communication means 211 and the car/hall communication path 22, and the controlling apparatus 13 controls the operation of the hoisting machine 12 shown in FIG. 1 based on the transmitted operation information. As a result, the elevator travels or stops according to the operation information from the operating terminal 16.

When the program is changed, the program in the operating terminal 16 is not changed, but only the program in the storage means 214 of the car/hall apparatus 21 maybe changed, and the changed program may be transferred from the storage means 214 of the car/hall apparatus 21 to the operating terminal 16.

Figure 3:
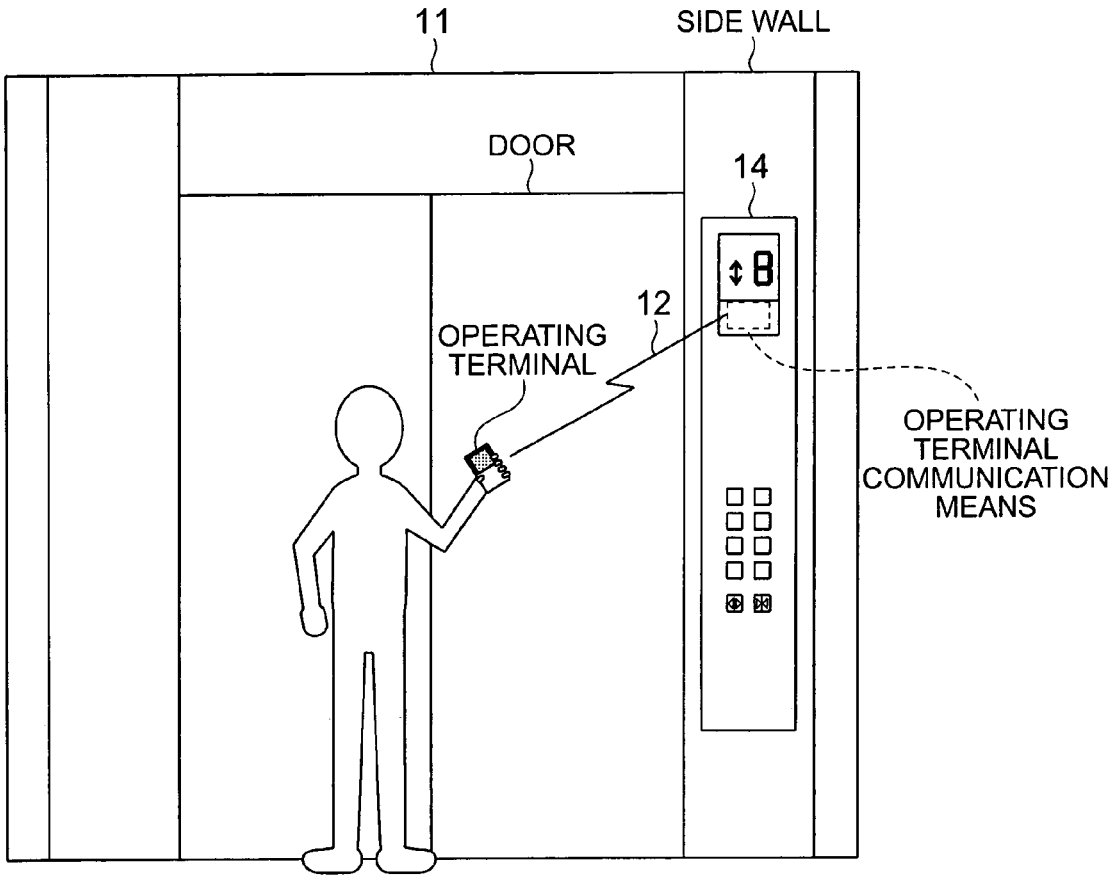
FIG. 3 is a drawing showing how to mount a car apparatus.

FIG. 3 shows how to mount the car apparatus 14. In this example, the car apparatus 14 also serves as a car operating panel. Of course, the car apparatus 14 may be separately provided independently of the car operating panel, and may be provided on the car in this case.

The front surface of the car apparatus 14 is covered with a faceplate (usually constituted by members made of resin or stainless steel). If the operating terminal communication path 23 described above is a wireless communication path, it is preferable that an antenna unit or a light receiving/emitting unit of the operating terminal communication means 212 is installed behind the faceplate for an aesthetic reason. In this case, a member (such as resin) through which radio wave, light, and the like used on the wireless communication path can be transmitted is used. Especially, when optical communication is used, the neighborhood of a display unit for showing a floor or a travel direction originally has high light transparency for the display. The optical communication light emitting/receiving unit of the operating terminal communication means 212 is provided at this part.

The hall apparatus 15, which is not shown, adopts the same installation method as the car apparatus 14.

Figure 4:
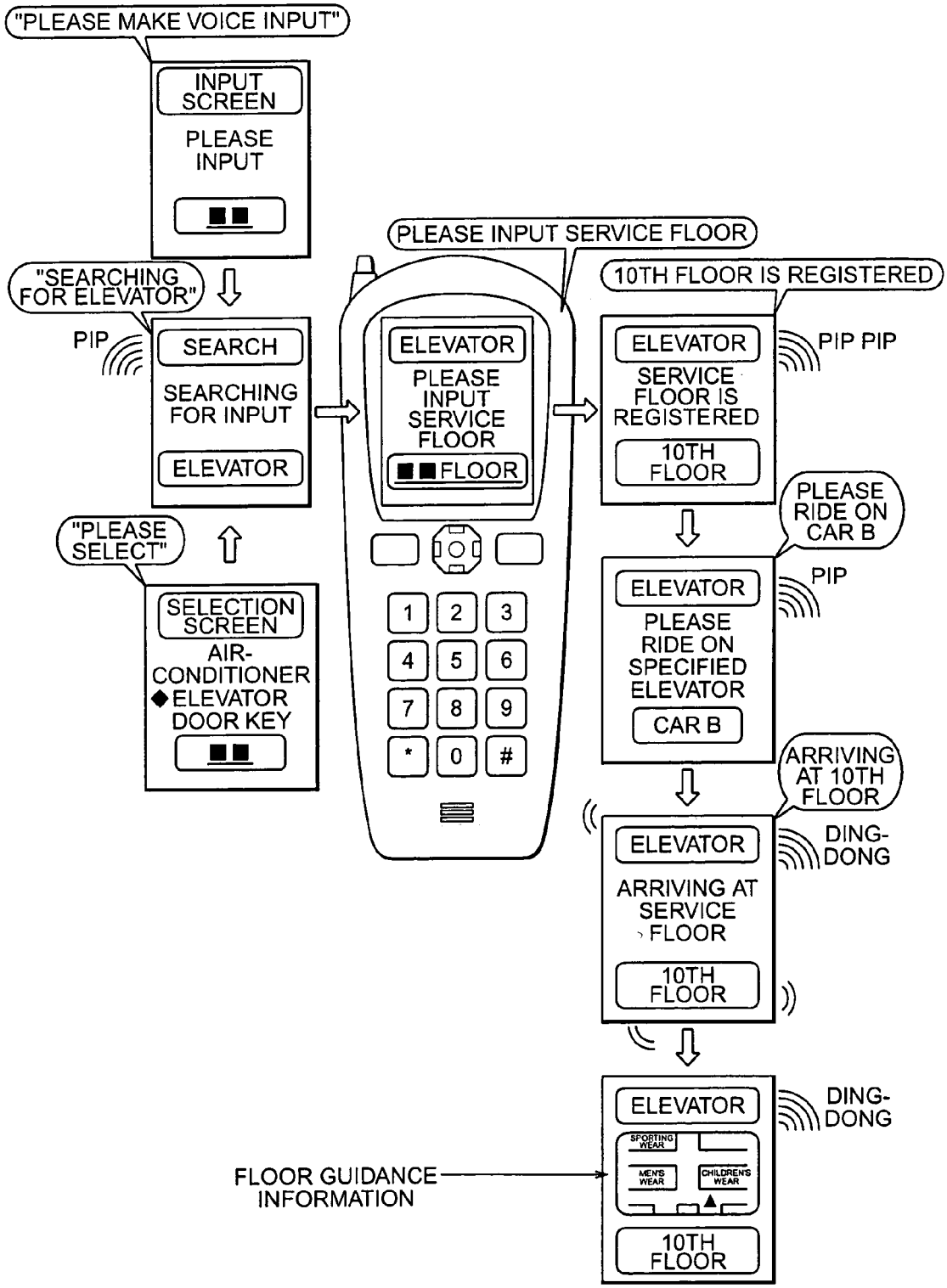
FIG. 4 is a drawing showing an example of an operation screen display of an operating terminal.

Then, FIG. 4 shows an example of an operation screen display of the operating terminal 16. First, the user inputs a keyword such as "elevator" or an associated keyword for selecting an elevator using voice, or selects "Elevator" on a selection screen on the operating terminal 16. In the input using voice, the inputted word is shown on the screen. In the input by selection, options are shown on the screen.

The operating terminal 16 communicates with the elevator system, and displays an elevator screen (namely downloads and executes an elevator operating program).

When the elevator operating program is downloaded, and executed on the operating terminal, an input screen for a service floor (a destination floor, 10th floor in this case) is shown on the operating terminal, or the input for a service floor is prompted using voice. The user inputs the service floor using a button, or voice input.

The inputted floor is shown and after the destination floor is registered to the elevator system controlling apparatus 13, the elevator system controlling apparatus 13 selects, for example, the nearest elevator or an elevator which reaches the destination floor earliest as an elevator to ride on when there are multiple elevators, and the car number of this elevator (a car number B in this case) is shown or announced using voice.

When publicly known detecting means detects that the user rides on a wrong elevator by mistake, or does not ride on the specified elevator by means of a timeout, an error indicating it is shown, and the user is prompted to ride on the correct elevator (not shown).

After that the user has ridden on the specified elevator is detected, the arrival at the service floor is shown immediately before the elevator stops at the service floor. This is realized such that the controlling apparatus 13 detects a floor immediately before the destination floor using publicly known art, the controlling apparatus 13 calculates the time period required or it to reach the position immediately before the arrival based on the distance between the floors and the velocity of the elevator using publicly known art, and notifies the portable terminal accordingly when the time is reached, and the portable terminal presents a screen display.

When the elevator stops at the service floor, or the passenger gets off the car, guidance on the floor is shown. This floor guidance information may be held by the program or may have been written to the memory in the operating terminal in advance independently of the program. The display is conducted on the operating terminal by means of character display, graphic display, sound notification, a sound effect (an electronic sound such as "pip" and melody), vibration of the operating terminal itself, and the like.

Figure 5:
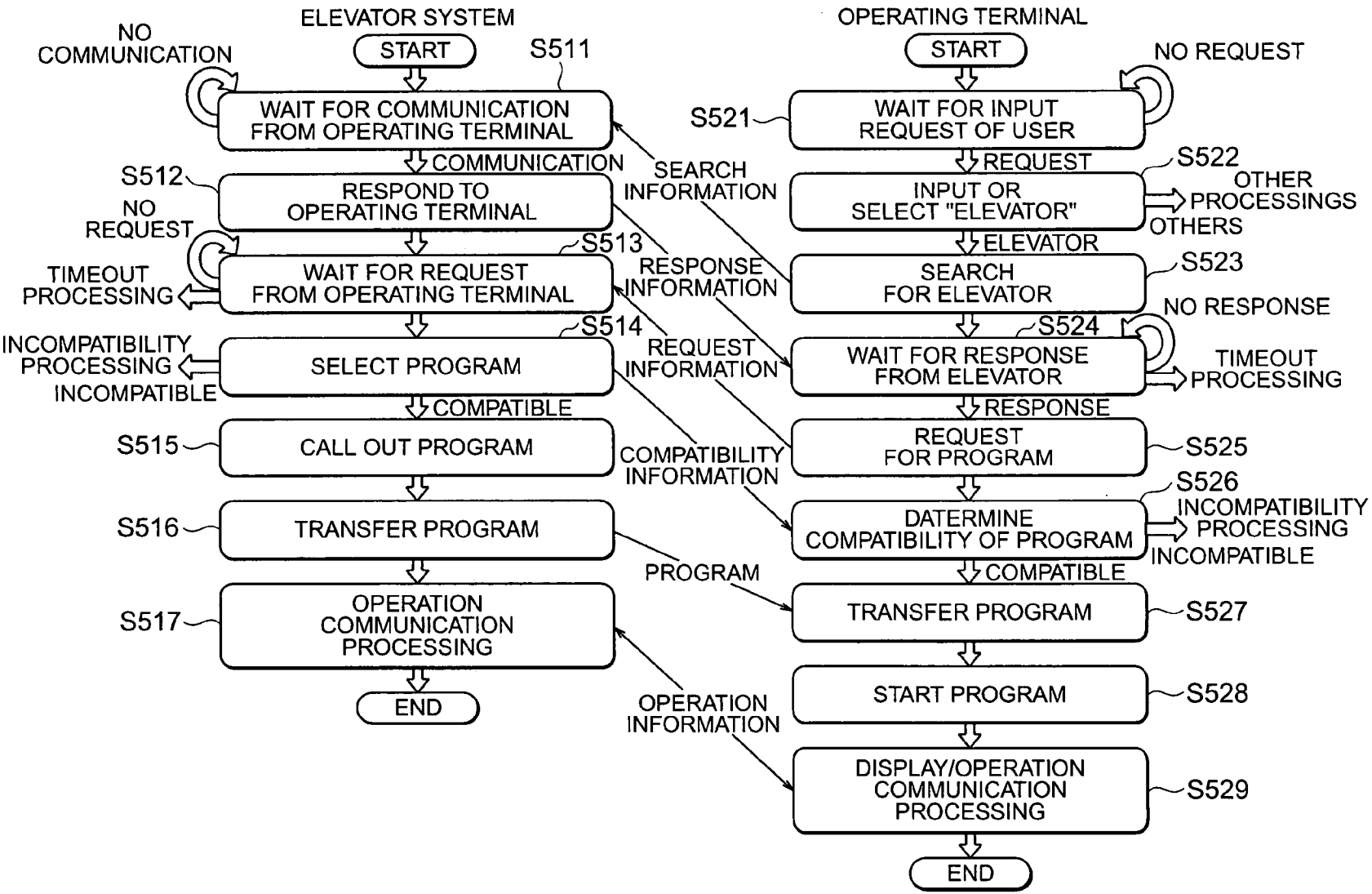
FIG. 5 is a flowchart showing a communication flow between an operating terminal and an elevator system.

A communication flow between the operating terminal and the elevator system is shown in FIG. 5.

(1) First, the elevator system stands in a state of waiting for a request from the operating terminal (Step S511).

(2) On the other hand, the operating terminal waits for an operation (such as a voice input, a button input/selection) of a user (Step S521), and determines an operation as a request for communication with the elevator when "elevator" (or a keyword associated with it) is input/selected (Step S522). When the input/selection is other than "elevator", other operation is conducted, and the procedure returns to the start.

(3) Then, the operating terminal searches for the elevator system (transmits a communication request) (Step S523).

(4) When the elevator system receives the communication request from the operating terminal, the system transmits a communication response to the operating terminal (Step S512).

(5) The operating terminal waits for the response from the elevator system (Step S524). After the operating terminal retries for limited times (including 0 time) when the response has not been received, the operating terminal determines that the elevator system is not in a communicable state (a wired communication path is not connected, or the elevator system is not within a wireless communication range) when the response is still not received, shows the determination to a user, and returns to the start (timeout processing).

(6) When the operating terminal is waiting for the response from the elevator system (Step S524), if the operating terminal receives the response from the elevator system, it transmits request information for requesting for a program to the elevator system (Step S525).

(7) The elevator system waits for the request information from the operating terminal (Step S513). If the elevator system does not receive the request information, it assumes that the operating terminal is not in a communicable state, or gives up the request, and returns to the start after a certain period (timeout processing).

(8) When the elevator system is waiting for the request information from the operating terminal (Step S513), if the elevator system receives the request information, it determines whether compatible programs are stored based on the request information (Step S514), selects the most suitable one from them, and transmits compatibility information. The elevator system transmits compatibility information including the information on the selected program or information representing a non-existing state if a compatible program does not exist to the operating terminal. In case of incompatibility, the elevator system conducts incompatibility processing, and returns to the start.

(9) The operating terminal receives the compatibility information, and determines the compatibility (Step S526). In case of incompatibility, the operating terminal conducts incompatibility processing (such as logging), shows the incompatibility (that the elevator cannot be used from the terminal and the user must use an operating panel of the elevator) to the user, and returns to the start.

(10) The elevator system loads the program from the storage means (Step S515), and transfers the program to the operating terminal (Step S516).

(11) When the operating terminal receives the transferred program (Step S527), the operating terminal executes the program (Step S528).

(12) From this point, the elevator system and the operating terminal execute operation (display) processing while communicating with each other (Steps S517 and S529).

After completing the series of operation described above, the elevator system and the operating terminal may return to the start (respectively Steps S511 and S521), or may be periodically started at a predetermined time interval.

If multiple types of the operating terminals exist, and they cannot operate on the same program, each operating terminal transmits operating terminal information indicating which type the operating terminal belongs to. For example, the operating terminal information may be a character (letter) code of "A", "B", or "C", or a code "01", "02", or "03" which is determined in a reference table of a communication protocol of the operating terminal if the operating terminal information indicates A, B, or C type.

The elevator system selects a stored program based on the operating terminal information, and transfers the program to the operating terminal.

In FIG. 5, when a user specifies search for an elevator from the operating terminal by means of voice or character input, and the system detects the input, the system determines that the request input is inputted from the outside. On the contrary, in FIG. 6, when the elevator system detects that a user carrying the operating terminal enters into a wireless communication range in an elevator hall (a landing) or stays for a certain period in the range, or detects that the user connects the operating terminal with a connector of a wired communication path, namely detects a state where an external request can be estimated, the system determines that a request from the outside exists.

Figure 6:
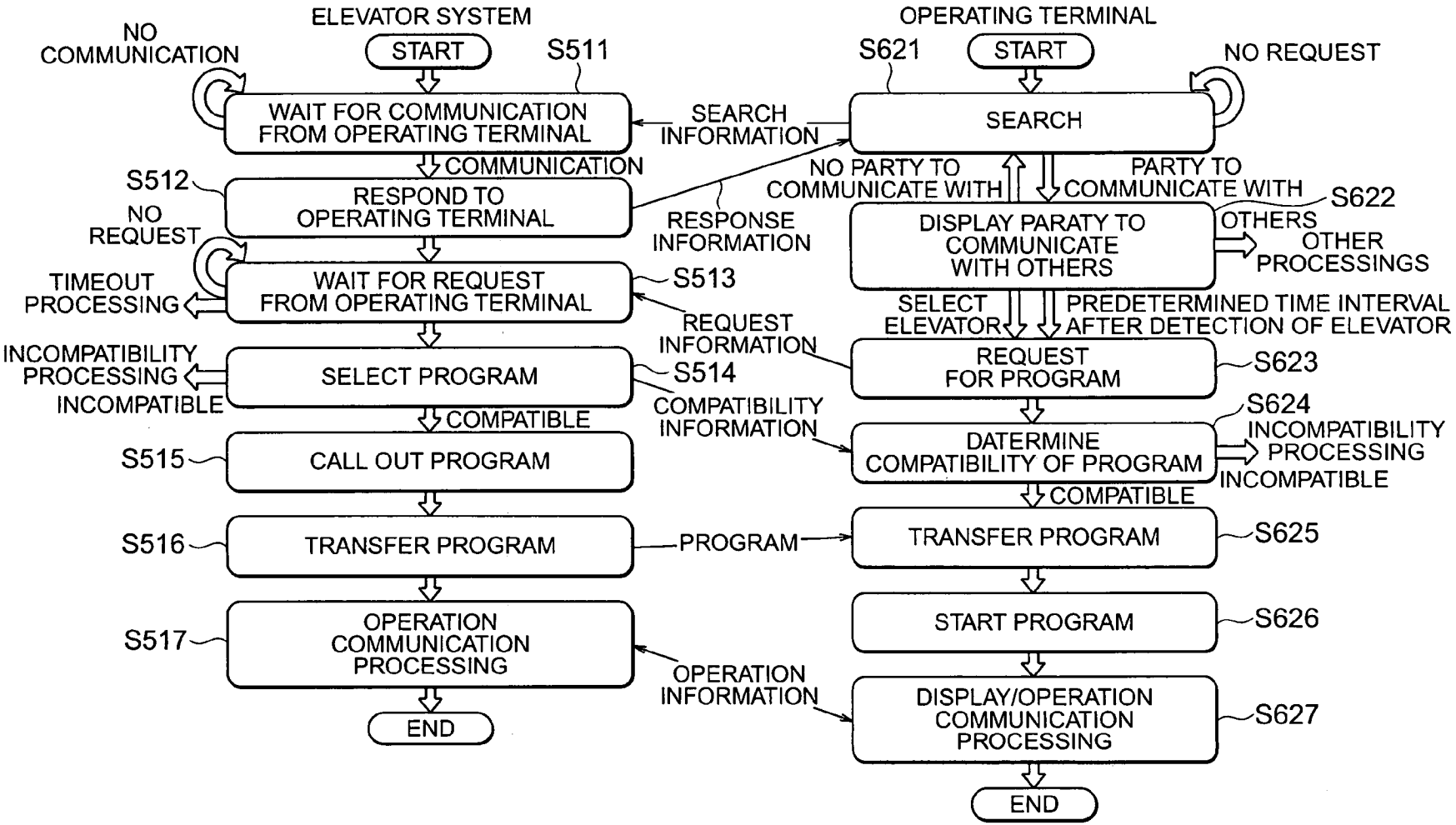
FIG. 6 is another flowchart showing the communication flow between the operating terminal and the elevator system.

Next, the operation in this case will be described while referring to FIG. 6.

(1) The elevator system stands in a state of waiting for a request from the operating terminal (Step S511).

(2) The operating terminal searches for whether an opposite party to communicate with exists or not (Step S621).

(3) The operating terminal searches for the elevator system (transmits a communication request) (Step S621). If there is no party to communicate with, the operating terminal repeats the search until a party to communicate with is detected.

(4) When the user enters in the communicable range with the elevator system, the elevator system receives the search information (the communication request) from the operating terminal, determines that an opposite party to communicate with exists, and transmits response information to the operating terminal (Step S512).

The case where the user enters into the communicable range with the elevator system means a case where the user carrying a cellular phone enters on the elevator floor (the landing) or the user stays on the elevator floor (the landing) for a certain period, for example.

(5) Then, the elevator system enters into a state of waiting for a request from the operating terminal (Step S513).

(6) When the user enters into the elevator floor (the landing), if the operating terminal receives the response information from one or more elevator systems, the operating terminal determines that an opposite party to communicate with exists, and shows on the screen the systems which have responded (Step S622). The user operates to select one from the one or more elevator systems shown.

When the user has stayed on the elevator floor (the landing) for the certain period, if there is one elevator system which has responded as a result of the search, the system is shown on the screen, and the operating terminal requests for a program from the elevator system after a certain period has passed.

(7) When the operating terminal has not received the response for a certain period, after the operating terminal retries for limited times (including 0 time), it determines that the elevator system is not in a communicable state (a wired communication path is not connected, the elevator system is not within a wireless communication range, etc.) when the response is still not received, shows the determination to the user, and returns to the start in Step S621 (timeout processing). When the selection is other than elevator, other operation is conducted, and the procedure returns to the start.

(8) The operating terminal transmits request information for requesting for a program to the elevator system when the elevator system responds (Step S623).

(9) The elevator system receives the request information from the operating terminal (Step S513). If the elevator system does not receive the request information, it assumes that the operating terminal is not in a communicable state or gives up the request, and returns to the start after a certain period (timeout processing).

(10) The elevator system determines whether compatible programs are stored based on the request information (Step S514), selects, if these programs exist, the most suitable one from them, and transmits compatibility information to the operating terminal. The elevator system transmits compatibility information including the information on the selected program or information representing a non-existing state if a compatible program does not exist, to the operating terminal. In case of incompatibility, the elevator system conducts incompatibility processing, and returns to the start.

(11) The operating terminal receives the compatibility information, and determines the compatibility (Step S624). In case of incompatibility, the operating terminal conducts incompatibility processing (such as logging), shows the incompatibility (that the elevator cannot be used with the terminal and the user must use an operating panel of the elevator) to the user, and returns to the start.

(12) Then the elevator system loads the program from the storage means (Step S515), and transfers the program to the operating terminal (Step S516).

(13) When the operating terminal receives the transferred program (Step S625), the operating terminal executes the program (Step S626).

(14) From this point, the elevator system and the operating terminal execute operation (display) processing while communicating with each other (Steps S517 and S627).

After completing the series of operation described above, the elevator system and the operating terminal may return to the start (respectively Steps S511 and S621), or may be periodically started at a predetermined time interval.

As described above, with the present embodiment, since the program dedicated to an elevator is transferred from the car/hall apparatus to the operating terminal whenever necessary, it is not necessary to provide an operating terminal dedicated to the elevator (including a terminal loaded with a dedicated program), and a general purpose terminal can meet the purpose. In addition, it is not necessary to (statically) install a program, which is dedicated to an elevator and adapted to all the elevator systems for individual types (functions) and specifications of the elevators, on an operating terminal of a user in advance, or to require a user to renew (update) a program. Thus, the user is freed from a complicated operation. Further, since it is only necessary to store programs compatible with functions and specifications of elevators to be adapted to in the elevator system, it is possible to suppress an increase in resource for the storage area, and an increase in the size of the programs.

With the improvement in the functions of the operating terminal, various functions such as voice synthesis, voice recognition, and user authentication are easily utilized for the elevator operating apparatus.

Second Embodiment

Figure 7:
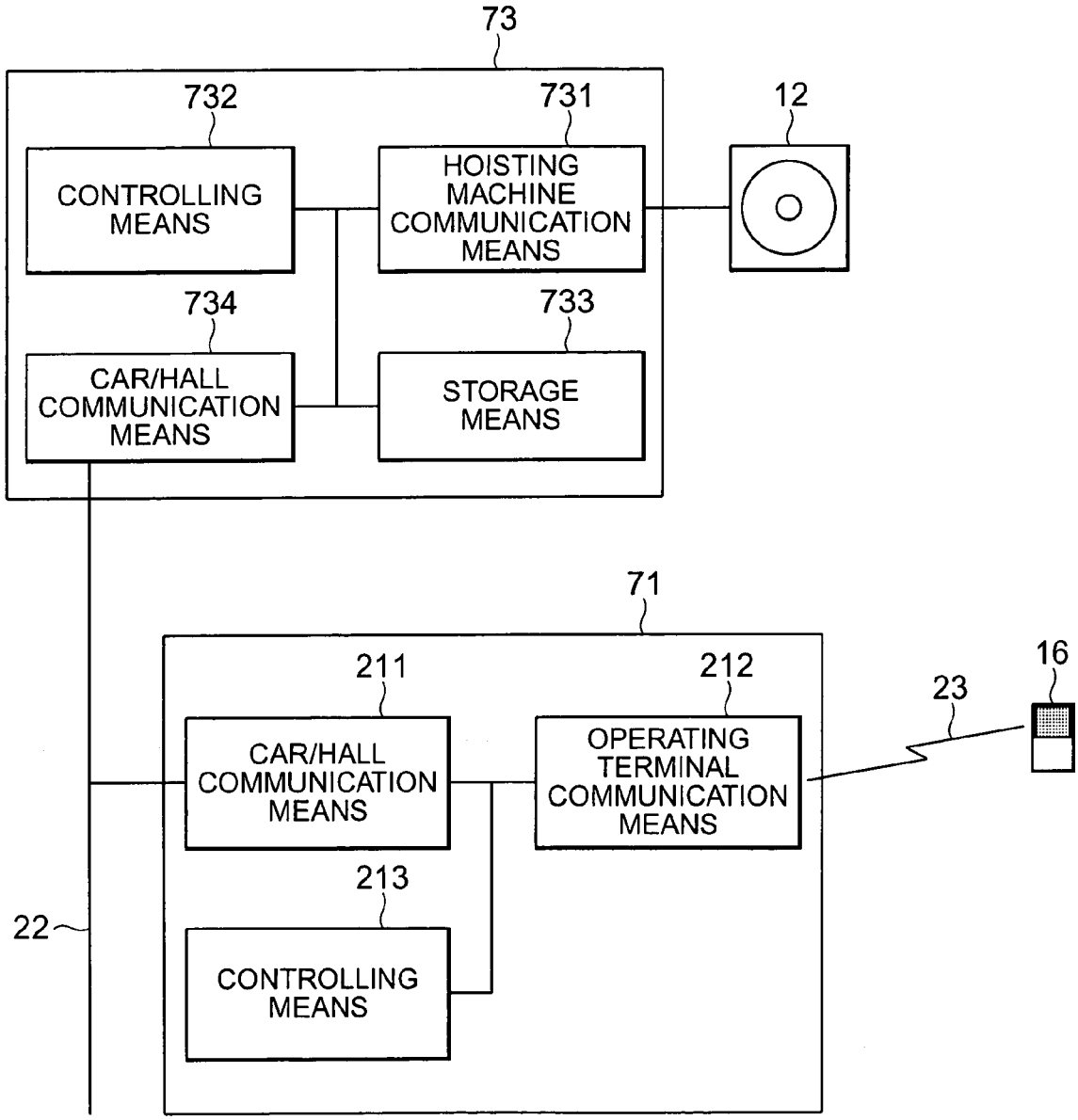
FIG. 7 is a block diagram showing a second embodiment of an operating apparatus for an elevator according to the present invention.

Next, an operating apparatus for an elevator according to a second embodiment will be described. FIG. 7 is a block diagram showing the second embodiment of the elevator operating apparatus according to the present invention. The second embodiment is different from the first embodiment shown in FIG. 1 in that a car/hall apparatus 71 does not have storage means, and a controlling apparatus 73 has storage means instead. As shown in FIG. 7, the car/hall apparatus 71 includes car/hall communication means 211 for communicating with the controlling apparatus 73 through a car/hall communication path 22, operating terminal communication means 212 for communicating with an operating terminal 16 through an operating terminal communication path 23, and controlling means 213 for controlling them. The controlling apparatus 73 includes hoisting machine communication means 631 for communicating with a hoisting machine 12, controlling means 632 for controlling them, storage means 633 for storing an operating terminal program executed under a virtual execution environment, and car/hall communication means 734 for communicating with the car/hall apparatus 71 through the car/hall communication path 22. The controlling means 213 and 732 of the car/hall apparatus 71 and the controlling apparatus 73 include a microcomputer for conducting control, a memory for storing a program executed on the microcomputer, and a memory used by the program during the execution. The individual communication means 211, 212, 731, and 734 include a communication microcomputer, and either both of a memory and a communication interface device or only the communication interface device used by the communication microcomputer. The storage means 733 includes a memory, especially a nonvolatile flash memory.

Next, there is described the operation. The controlling means 732 of the controlling apparatus 73 controls the car/hall communication means 734 to communicate with the car/hall apparatus 71, and controls the hoisting machine communication means 731 to communicate with the hoisting machine 12. The controlling means 213 of the car/hall apparatus 71 controls the operating terminal communication means 212 to communicate with the operating terminal 16, and controls the car/hall communication means 211 to communicate with the controlling apparatus 73. A program stored in the storage means 733 of the controlling apparatus 73 is transferred to the operating terminal 16 through the car/hall communication path 22, the car/hall communication means 211 of the car/hall apparatus 71, the operating terminal communication means 212, and the operating terminal communication path 23. The operating terminal 16 executes the transferred program under the virtual execution environment. Consequently, operation information is transmitted from the operating terminal 16 to the car/hall apparatus 71 through the operating terminal communication path 23, and is transmitted to the controlling means 213 through the operating terminal communication means 212 in the car/hall apparatus 71. The controlling means 213 of the car/hall apparatus 71 communicates with the controlling means 732 of the controlling apparatus 73 through the car/hall communication means 211, the car/hall communication path 22, and the car/hall communication means 734 of the controlling apparatus 73 based on the transferred operation information. The controlling means 732 of the controlling apparatus 73 controls the operation of the hoisting machine 12 through the hoisting machine communication means 731. As a result, the elevator travels or stops according to the operation of the operating terminal 16.

When a change to the program occurs, the program in the operating terminal 16 is not changed, but only the program in the storage means 733 of the controlling apparatus 73 may be changed, and the changed program may be transferred from the storage means 733 of the controlling apparatus 73 to the operating terminal 16 through the car/hall communication path 22, the car/hall apparatus 71, and the operating terminal communication path 23.

As described above, with the second embodiment, since the program dedicated to an elevator is transferred from the car/hall apparatus to the operating terminal whenever necessary, it is possible to realize an elevator operating apparatus which does not require a terminal dedicated for the elevator and is provided with a user terminal on which it is not necessary to (statically) install a program dedicated to an elevator and adapted to all the elevator systems in advance, and does not require a user to renew (update) a program.

Also, with the second embodiment, it is not necessary to secure the storage means used for the program of the operating terminal for each car/hall apparatus, and at least one is necessary for an elevator system, which is different from the first embodiment. Thus, it is possible to constitute the system with a smaller amount of resource (the memory capacity of the storage means) compared with the first embodiment. Since the program for the operating terminal is transferred through the car/hall communication path, it is necessary to pay attention to securing the bandwidth of the communication path.

Third Embodiment

When a memory serving as storage means for storing several types of programs executed under a virtual execution environment is secured in each car/hall apparatus, if there are six car apparatuses, and there are four hall apparatuses for each hall, which totals 32 apparatuses for eight floors, in an elevator system where six elevators stop at the eight floors, the total of 38 memories are required. Usually the size of the program executed under the virtual execution environment ranges from several kilobytes to several hundred kilobytes. If a memory which stores three types of program of 10 kilobytes is provided, a capacity of 30 kilobytes is required for each car/hall apparatuses, and total capacity of 1140 kilobytes is required. On the contrary, if the storage means is provided only for the controlling apparatus, the capacity is as small as 30 kilobytes.

On the other hand, when user wants to use the elevator, it is desirable that the program is transferred to the operating terminal immediately. Usually, it is said that a user thinks about 300 milliseconds as immediate. If it is assumed that time of 100 milliseconds within 300 milliseconds is necessary to start the program, the time used for the transfer is 200 milliseconds on balance. When a program of 10 kilobytes is transferred in 200 milliseconds, a bandwidth of 50 kilobytes/second (400 kilobits/second) is necessary. Though it is assumed that the possibility that multiple users use the program simultaneously (within 200 milliseconds) is extremely low, in terms of the car/hall communication path, when the storage means is provided for the controlling apparatus, the possibility increases in proportional to the number of the connected car/hall apparatuses, and it is necessary to secure a wider bandwidth for the car/hall communication path. Also, it is necessary to take into consideration a transfer bandwidth other than that for the program transfer between the controlling apparatus and the car/hall apparatus.

Thus, the advantage in the constructions in FIG. 2 and FIG. 7 is determined based on the tradeoff between the capacity of the memory serving as the storage means, and the bandwidth of the communication path.

Figure 8:
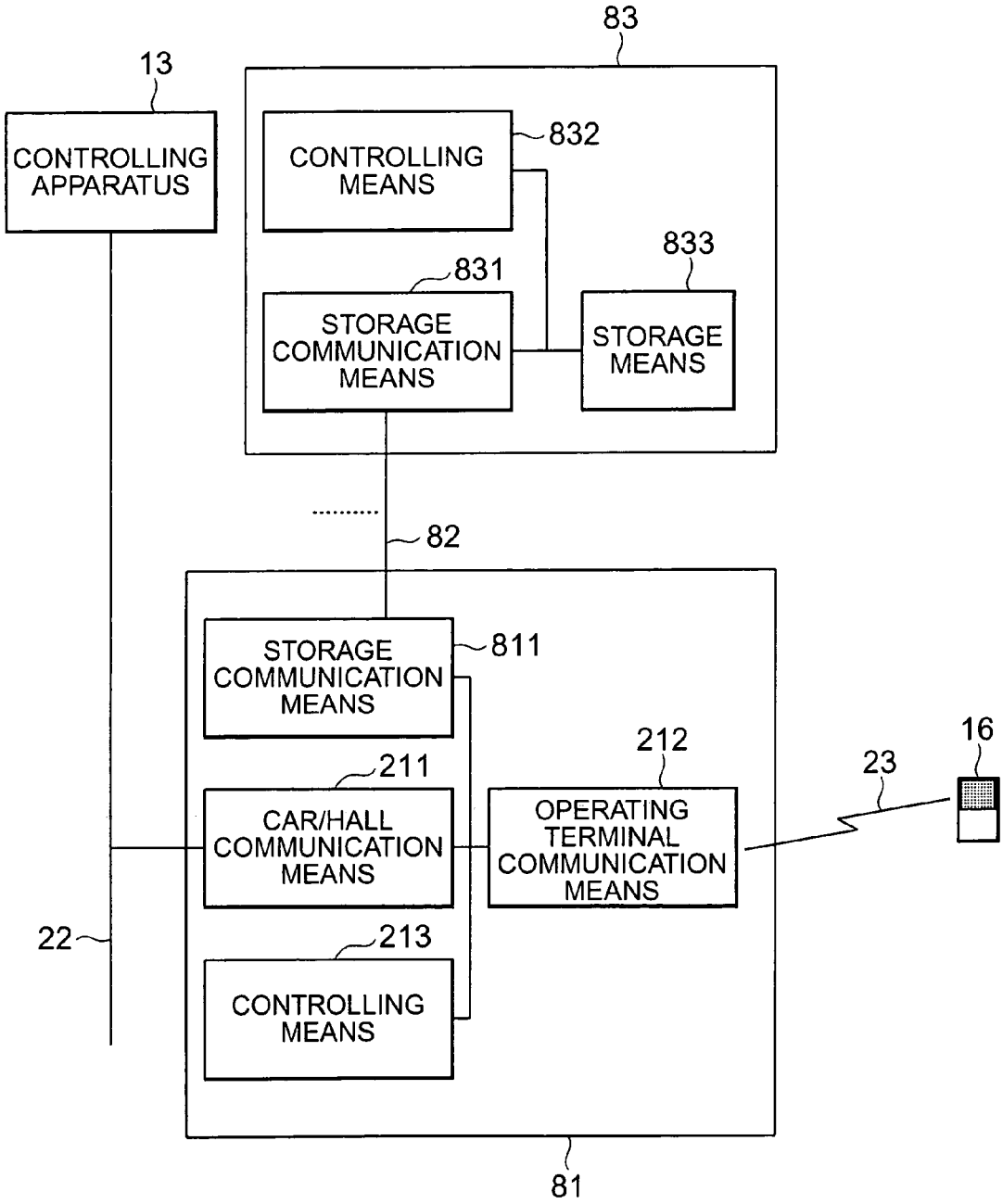
FIG. 8 is a block diagram showing a third embodiment of an operating apparatus for an elevator according to the present invention.

FIG. 8 shows the construction of a third embodiment of the elevator operating apparatus according to the present invention. The third embodiment is different from the first and second embodiments in that the storage means is provided not in the car/hall apparatus or the controlling apparatus, but in a storage apparatus provided independently.

As shown in FIG. 8, a car/hall apparatus 81 includes car/hall communication means 211 for communicating with a controlling apparatus 13 through a car/hall communication path 22, operating terminal communication means 212 for communicating with an operating terminal 16 through an operating terminal communication path 23, storage communication means 811 for communicating with a storage apparatus 83 through a storage communication path 82, and controlling means 213 for controlling them. The storage apparatus 83 includes storage communication means 831 for communicating with the car/hall apparatus 81 through the storage communication path 82, controlling means 832 for controlling it, and storage means 833 for storing an operating terminal program executed under a virtual execution environment. The controlling means 213 and 832 of the car/hall apparatus 81 and the storage apparatus 83 include a microcomputer for conducting control, a memory for storing a program executed on the microcomputer, and a memory used by the program during the execution. The individual communication means 211, 212, 811, and 831 include a communication microcomputer, and either both of a memory and a communication interface device or only the communication interface device used by the communication microcomputer. The storage means 833 includes a memory, especially a nonvolatile flash memory.

Next, the operation will be described.

The controlling means 213 of the car/hall apparatus 81 controls the operating terminal communication means 212 to communicate with the operating terminal 16, controls the car/hall communication means 211 to communicate with the controlling apparatus 13, and controls the storage communication means 811 to communicate with the storage apparatus 83. The program stored in the storage means 833 of the storage apparatus 83 is transferred to the operating terminal 16 through the storage communication path 82, the car/hall apparatus 81, and the operating terminal communication path 23. The operating terminal 16 executes the transferred program under the virtual execution environment. The operating terminal 16 communicates with the controlling apparatus 13 through the car/hall apparatus 41 when necessary.

With this construction, it is not necessary to prepare storage means for each car/hall apparatus, or to form the car/hall communication path between the controlling apparatus and the car/hall apparatus with a broad bandwidth, which is different from the first and the second embodiments. However, there increases a possibility that this may result in disadvantage in terms of cost since it is necessary to prepare a new storage apparatus and a storage communication path, and storage communication means for them. Thus, it is suitable for a case where an existing controlling apparatus and a car/hall communication path are used, and it is not necessary to provide storage means for a car/hall apparatus as standard.

Fourth Embodiment

Figure 9:
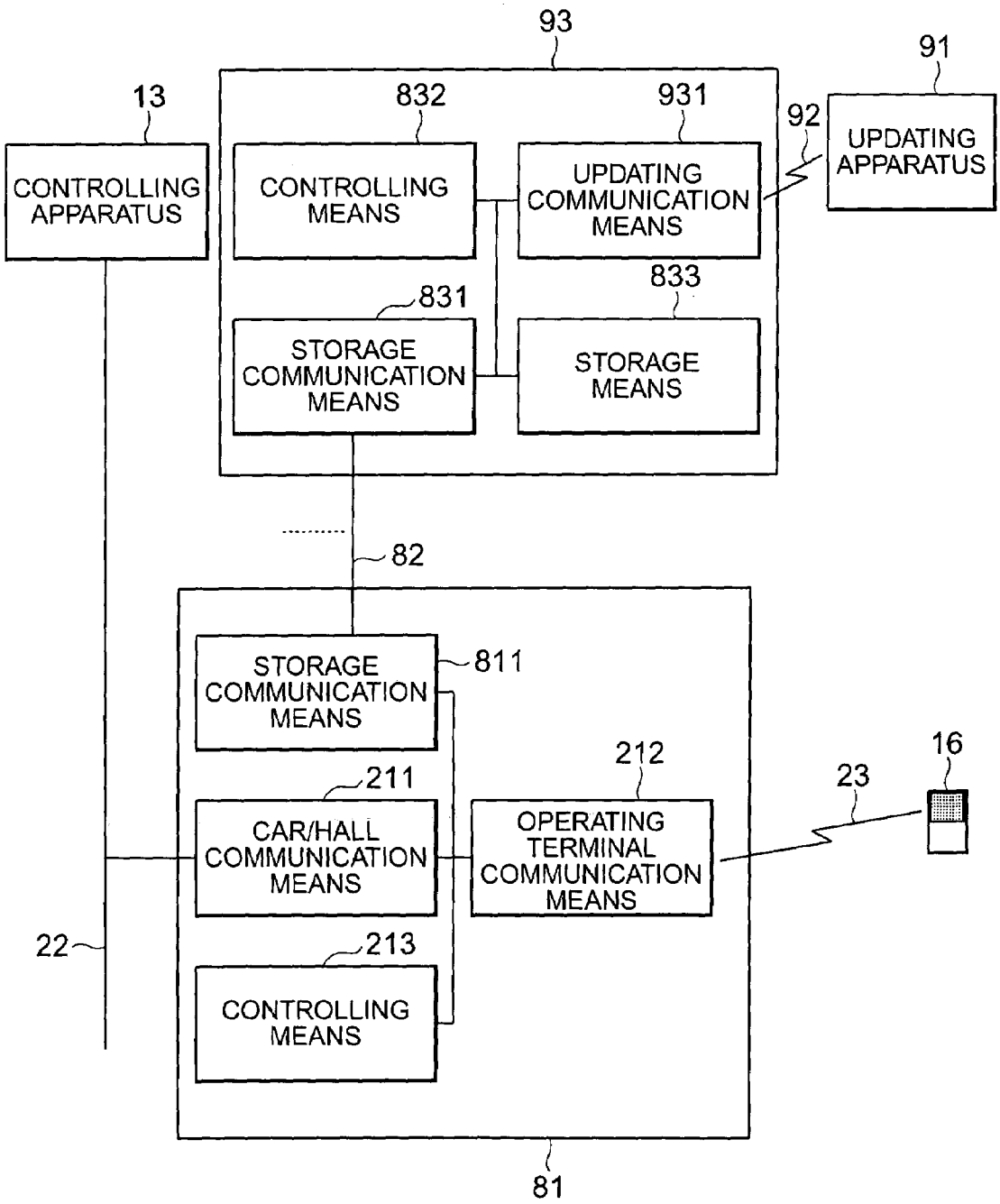
FIG. 9 is a drawing showing a mechanism for renewing/making an addition to a program stored in storage means.
Figure 10:
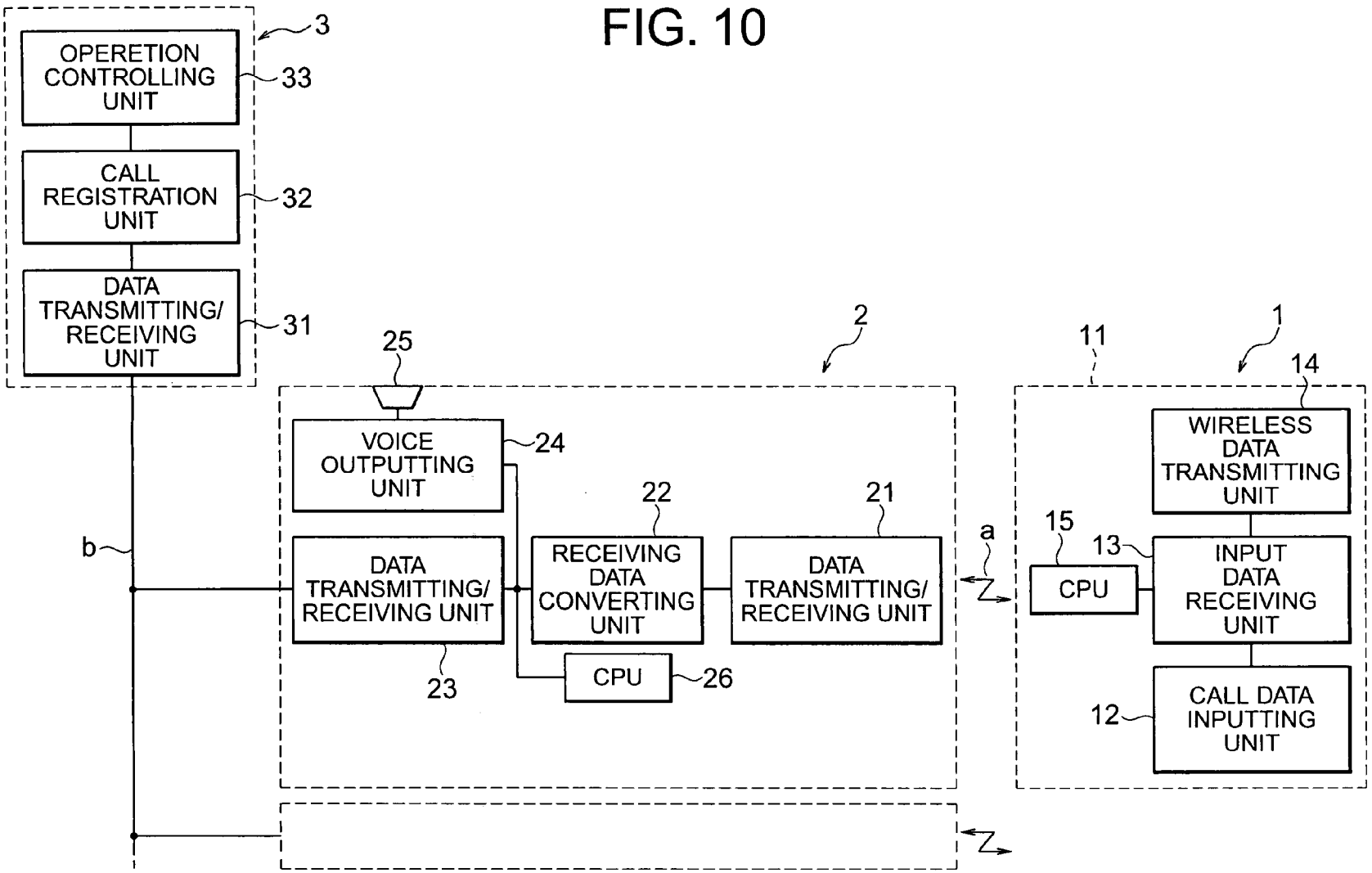
FIG. 10 is a block diagram showing a conventional elevator system.

It may be necessary to renew or make an addition to an operating terminal program stored in each storage means when a need arises to meet a new type of the virtual execution environment of the operating terminal. Thus, in a fourth embodiment, a mechanism for renewing/making an addition to the program stored in the storage means is added for this case. FIG. 9 is a block diagram showing the fourth embodiment of the elevator operating apparatus according to the present invention, and updating communication means is added to the storage apparatus in the construction shown in FIG. 8. In FIG. 9, the same reference numerals as those in FIG. 8 denote the identical or equivalent components. Reference numeral 91 indicates an updating apparatus for executing an updating program, reference numeral 93 indicates a storage apparatus, reference numeral 92 indicates an updating communication path connecting between the updating apparatus 91 and the storage apparatus 93, and reference numeral 931 indicates updating communication means provided in the storage apparatus 93, and communicating with the updating apparatus.

The updating apparatus 91 includes a cellular phone, a portable terminal or a personal computer as the operating terminal 16. The updating communication path 92 maybe constituted by a wireless/wired communication path for a short distance or a telephone line for connecting with the updating apparatus 91 located at a remote site.

Next, the operation will be described.

The storage apparatus 93 controls the updating communication means 931 to transfer the updating program to the updating apparatus 91 through the updating communication path 92. The updating apparatus 91 executes the updating program to update a program in the storage means 733. Then, the updated program is transferred to the operating terminal 16 under the control of the controlling means 732 and the controlling means 213 through the storage communication means 731, storage communication means 711, and the operating terminal communication means 212.

Hereinafter, the operation is the same as the first and second embodiments.

Also, it is possible to use the operating terminal communication means 212 of the car/hall apparatus 71, and to update the program stored in the storage means from the operating terminal 16 provided with an updating apparatus or updating means which can be connected with the operating terminal communication path 23 without newly providing the updating communication means 931 in the storage apparatus 93, which is not illustrated. In this case, the updating apparatus or the operating terminal 16 transfers the program through the car/hall apparatus 71 to the apparatus provided with the storage means (namely in a procedure inverse with respect to that for transferring the program from the storage means 733), and updates the program stored in the storage means 733.

With this construction, it is possible to renew or make an addition to the operating terminal program stored in the individual storage means when a need arises to meet a new type of the virtual execution environment of the operating terminal.

In addition, compared with the case where the program is updated in each car/hall apparatus, the load is further reduced and the content of the update is centralized when the single update apparatus conducts the update.

INDUSTRIAL APPLICABILITY

As described above, since the elevator operating apparatus according to the present invention transfers an optimal program to an operating terminal according to the type and the like, and executes this program to control an elevator, the elevator operating apparatus is suitable for utilizing a general-purpose terminal

What is claimed is:

1. An elevator operating apparatus comprising:

an elevator system for storing a program;

an operating terminal connected with said elevator system through a wireless or wired network for executing the program in a virtual execution environment; and communication means for transferring the program from said elevator system to said operating terminal.

2. The elevator operating apparatus according to claim 1, further comprising request detecting means for detecting a request input from outside or a state where a request can be estimated, wherein said elevator system with which said operating terminal can communicate is detected through scanning based on a detection result from said request detecting means, thereby selecting said elevator system.

3. The elevator operating apparatus according to claim 2, wherein said elevator system selected by said operating terminal selects a program to be transferred to said operating terminal based on operating terminal information obtained from said operating terminal.

4. The elevator operating apparatus according to claim 1 wherein said elevator system comprises:

at least one car/hall apparatus that stores the program; and a controlling apparatus for controlling said car/hall apparatus, wherein the program is transferred from said car/hall apparatus to said operating terminal.

5. The elevator operating apparatus according to claim 1, wherein said elevator system comprises:

at least one car/hall apparatus; and a controlling apparatus for controlling said car/hall apparatus and storing the program, wherein the program is transferred from said storage apparatus to said operating terminal.

6. The elevator operating apparatus according to claim 1, wherein said elevator system comprises:

at least one car/hall apparatus;

a storage apparatus connected with said car/hall apparatus for storing said program; and a controlling apparatus for controlling said car/hall apparatus, wherein the program is transferred from said storage apparatus to said operating terminal.

7. The elevator operating apparatus according to claim 1, wherein said elevator system includes an updating apparatus for updating the program.

8. An elevator operating apparatus comprising:

an elevator system storing a program for operating an elevator of said elevator system;

an operating terminal for communication with said elevator system and downloading the program for execution on the terminal in a virtual execution environment; and communication means for downloading the program from said elevator system to said operating terminal.

9. The elevator operating apparatus according to claim 8 wherein said elevator system comprises:

at least one car/hall apparatus that stores the program; and a controlling apparatus for controlling said car/hall apparatus, wherein the program is transferred from said car/hall apparatus to said operating terminal.

10. The elevator operating apparatus according to claim 8, wherein said elevator system comprises:

at least one car/hall apparatus; and a controlling apparatus for controlling said car/hall apparatus and storing the program, wherein the program is transferred from said storage apparatus to said operating terminal.

11. The elevator operating apparatus according to claim 8, wherein said elevator system comprises:

at least one car/hall apparatus;

a storage apparatus connected with said car/hall apparatus for storing the program; and a controlling apparatus for controlling said car/hall apparatus, wherein the program is transferred from said storage apparatus to said operating terminal.

12. The elevator operating apparatus according to claim 8, wherein said elevator system includes an updating apparatus for updating the program.

13. The elevator operating apparatus according to claim 8, wherein said elevator system, when in communication with said operating terminal, selects a program to be downloaded to said operating terminal based on operating terminal information communicated to said elevator system from said operating terminal.

14. An elevator operating apparatus comprising:

an elevator system for storing a plurality of programs for operating an elevator of said elevator system, each program being executable in a virtual execution environment on a respective operating terminal;

a plurality of operating terminals for communication with said elevator system, each operating terminal downloading one of the programs that is compatible with and executable on the respective operating terminal in a virtual execution environment; and communication means for downloading the programs from said elevator system to respective operating terminals.

15. The elevator operating apparatus according to claim 14 wherein said elevator system comprises:

at least one car/hall apparatus that stores the programs; and a controlling apparatus for controlling said car/hall apparatus, wherein one of the programs is transferred from said car/hall apparatus to a respective operating terminal.

16. The elevator operating apparatus according to claim 14, wherein said elevator system comprises:

at least one car/hall apparatus; and a controlling apparatus for controlling said car/hall apparatus and storing programs, wherein one of the programs is transferred from said storage apparatus to a respective operating terminal.

17. The elevator operating apparatus according to claim 14, wherein said elevator system comprises:

at least one car/hall apparatus;

a storage apparatus connected with said car/hall apparatus for storing the programs; and a controlling apparatus for controlling said car/hall apparatus, wherein one of the programs is transferred from said storage apparatus to a respective operating terminal.

18. The elevator operating apparatus according to claim 14, wherein said elevator system includes an updating apparatus for updating the program.

19. The elevator operating system according to claim 14, wherein said elevator system, when in communication with one of said operating terminals, selects the program to be downloaded to the respective operating terminal based upon operating terminal information communicated to said elevator system by the respective operating terminal.

* * * * *